US007113065B2

(12) United States Patent
Skibinski

(10) Patent No.: US 7,113,065 B2
(45) Date of Patent: Sep. 26, 2006

(54) MODULAR INDUCTOR FOR USE IN POWER ELECTRONIC CIRCUITS

(75) Inventor: Gary Leonard Skibinski, Milwaukee, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 152 days.

(21) Appl. No.: 10/675,314

(22) Filed: Sep. 30, 2003

(65) Prior Publication Data

US 2005/0068147 A1 Mar. 31, 2005

(51) Int. Cl.
*H01F 27/02* (2006.01)
*H01F 27/28* (2006.01)

(52) U.S. Cl. ..... 336/90; 336/170; 323/305

(58) Field of Classification Search ..... 336/55, 336/5, 61, 65, 96, 12, 90, 212, 180–181, 336/200; 363/4, 35; 323/304–308
See application file for complete search history.

(56) References Cited

U.S. PATENT DOCUMENTS 4,224,660 A * 9/1980 Mohan ..... 363/48
4,307,442 A * 12/1981 Yano et al. ..... 363/51
4,788,635 A * 11/1988 Heinrich ..... 363/35
5,210,513 A * 5/1993 Khan et al. ..... 336/61
6,215,371 B1 * 4/2001 Kurahashi et al. ..... 333/1.1
6,392,519 B1 * 5/2002 Ronning ..... 336/90
6,487,096 B1 * 11/2002 Gilbreth et al. ..... 363/35
6,812,676 B1 * 11/2004 Tateishi ..... 323/225
6,850,426 B1 * 2/2005 Kojori et al. ..... 363/123
6,856,283 B1 * 2/2005 Jacobson et al. ..... 342/368
2003/0133257 A1 * 7/2003 Beihoff et al. ..... 361/600
2004/0239467 A1 * 12/2004 Liu et al. ..... 336/200

FOREIGN PATENT DOCUMENTS

JP 11195533 A * 7/1999

* cited by examiner

*Primary Examiner*—Anh Mai
(74) *Attorney, Agent, or Firm*—Patrick S. Yoder; William R. Walburn

(57) ABSTRACT

A modular inductor arrangement is provided in which a footprint of an enclosure for single or multiple phase inductors provides enhanced thermal transfer. The inductor coil may be wound about an axis generally parallel to a mounting surface of the package, so as to provide for reduced height and expanded footprint dimensions. The inductor package may be mounted on a thermal support, such as a fluid-cooled support. Heat is extracted from the assembly during operation, so as to establish a reduced maximum internal temperature as compared to here for known structures. The arrangement may be included in various circuit configurations, such as power converters. Other components may be incorporated and integrated into the package, including sensors, capacitor coils, other inductor coils, and so forth.

20 Claims, 9 Drawing Sheets

FIG. 1a
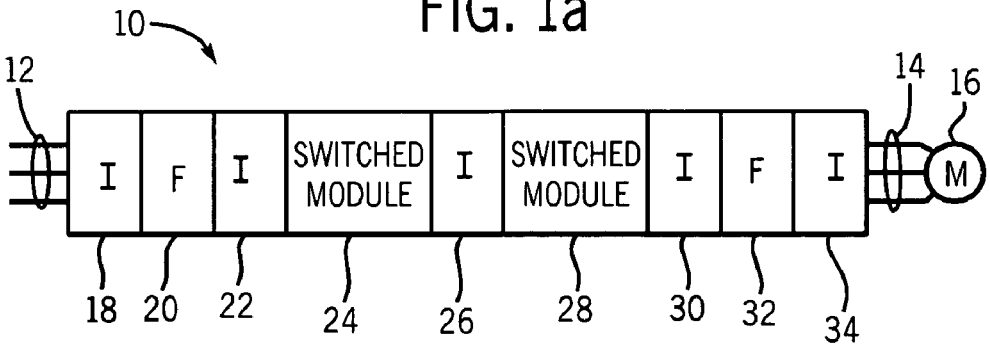
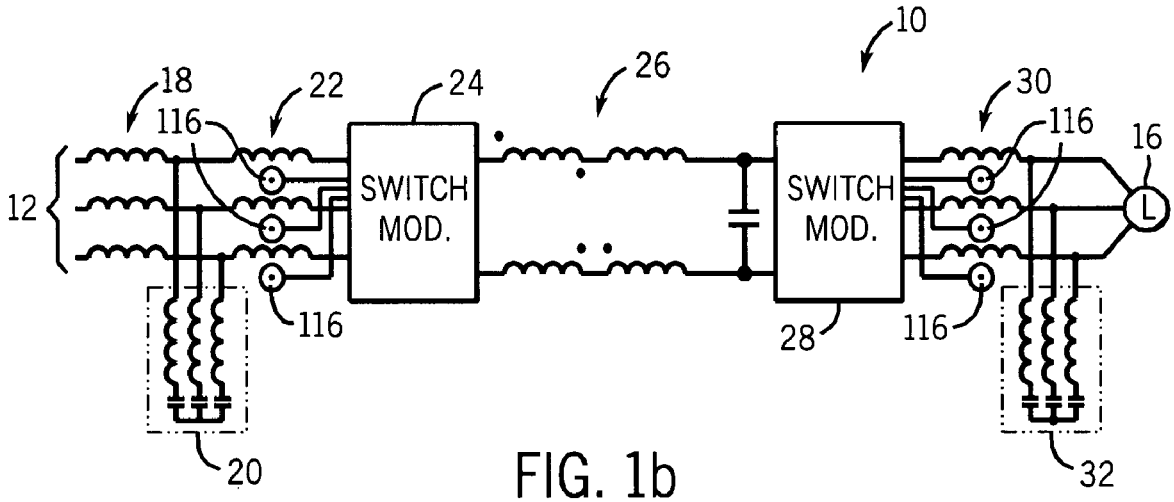
FIG. 1b
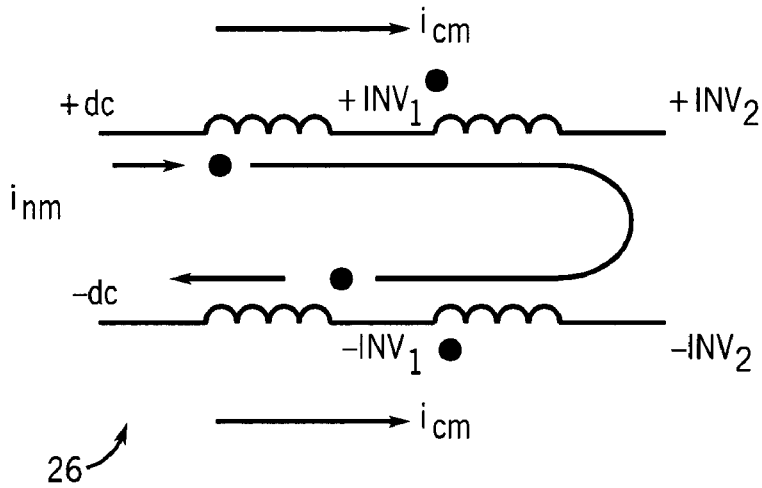
FIG. 1c

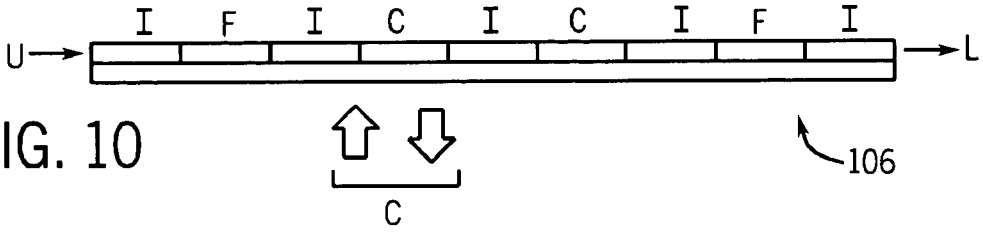
FIG. 10
FIG. 11
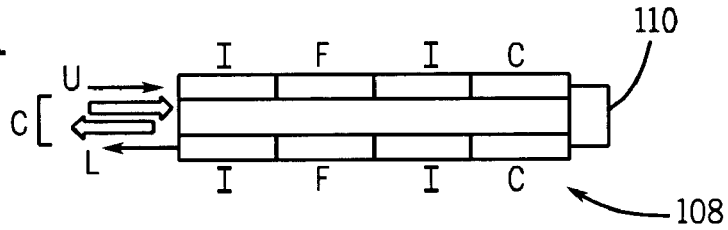
FIG. 12
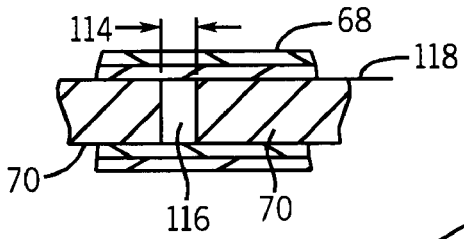
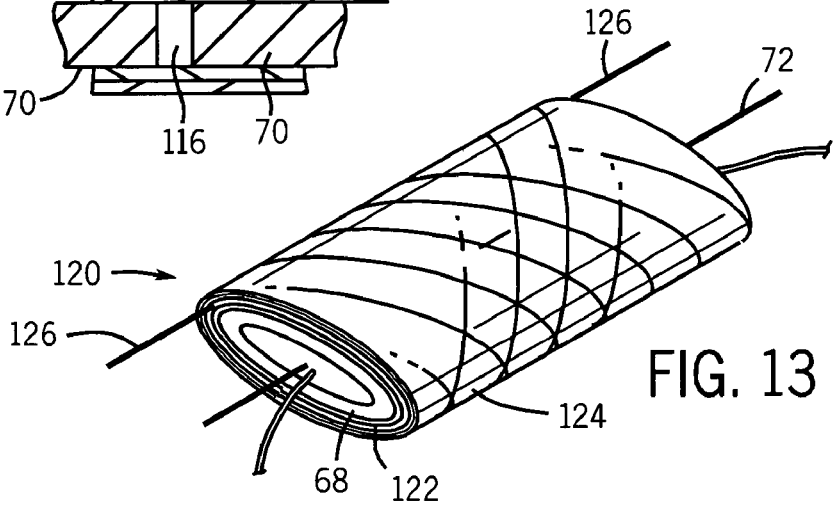
FIG. 13
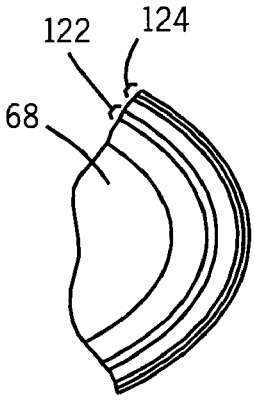
FIG. 14
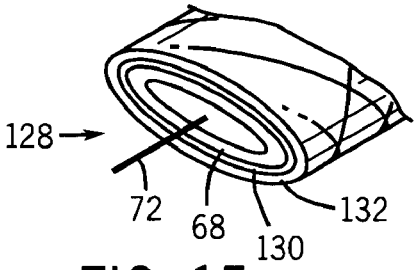
FIG. 15
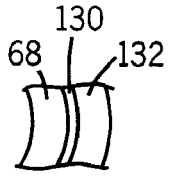
FIG. 16

MODULAR INDUCTOR FOR USE IN POWER ELECTRONIC CIRCUITS

BACKGROUND OF THE INVENTION

The present invention relates generally to the field of power electronic devices such as those used in power conversion or to apply power to motors and similar loads. More particularly, the invention relates to an improved inductor arrangement which can be incorporated in a modular fashion in various circuits and which provides enhanced component integration and thermal characteristics.

In the field of power electronic devices, a wide range of circuitry is known and currently available for converting, producing and applying power to loads. Depending upon the application, such circuitry may convert incoming power from one form to another as needed by the load. In a typical arrangement, for example, constant (or varying) frequency alternating current power (such as from a utility grid or generator) is converted to controlled frequency alternating current power to drive motors, and other loads. In this type of application, the frequency of the output power can be regulated to control the speed of the motor or other device. Many other applications exist, however, for power electronic circuits which can convert alternating current power to direct current power, or vice versa, or that otherwise manipulate, filter, or modify electric signals for powering a load. Circuits of this type generally include inverters, converters, and similar switched circuitry. Other applications include universal power controllers, micro-turbine generators, universal power sources, and so forth.

Many power electronic circuits of the type mentioned above require filtration through the use of chokes or inductors used on either a line side or a load side of the circuitry, or both. Such inductors serve to limit current, shape waveforms and improve harmonics. In addition, certain circuitry may employ direct current link inductors, such as between two inverter circuits in a drive application. Common mode inductors are also employed, depending upon the system requirements.

Depending upon the system configuration, input and output power levels, frequencies, and so forth, chokes and inductors used in power electronic circuits can be quite sizeable. The physical packaging in such applications becomes problematic, both from mounting and interconnection standpoints. Furthermore, due to the inherent functionality of the inductors, large amounts of heat may be generated during operation which must be dissipated to maintain the internal temperatures of the inductor within a desired thermal operating range. In large packaged inductors, such thermal management becomes extremely problematic. For example, currently available inductors that can be scaled to power electronic circuits include packaging configurations in which a bundle of conductive wire is disposed within an encapsulated shell. A potting material, typically epoxy, is disposed within the shell to seal the structure. These structures are not, however, completely modular in design, and require termination of leads extending from the shell. While a certain amount of cooling can be provided against a face of the shell, and cooling conductors can be routed through an aperture formed in the shell, these measures are typically insufficient to develop the desired level of cooling of interior regions of the structure. Moreover, the axial winding (conductors wrapped about the central axis perpendicular to the mounting base) makes further extensions of cooling surfaces difficult or impossible.

In addition to the packaging and cooling considerations mentioned above, modularity could be a useful feature of inductor structures. However, as mentioned, very little if any modularity is provided in existing inductor packaging. Furthermore, current inductors incorporate little or no additional circuitry. Such additional circuitry, that would be useful in packaged modular inductors may include integrated current sensors, ground fault sensing arrangements, capacitors, voltage sensors, integrated common mode inductor and link inductor packages, and so forth. Such arrangements are currently unavailable with existing technologies.

There is a need, therefore, for improved choke or inductor arrangements. There is a particular need for inductors which can be configured and packaged to provide modularity, enhanced thermal characteristics, and possible integration of additional components and circuitry into the same modular package.

SUMMARY OF THE INVENTION

The present invention provides an inductor configuration designed to respond to such needs. The technique employs a modular inductor which can establish an improved thermal gradient so as to drive cooling of internal regions into a desired thermal range during operation. The package preferably includes an expanded footprint as compared to heretofore known structures, thereby providing a greater surface through which heat may be transferred. The modular package may include leads that extend from the inductor conductive elements for simple and straightforward incorporation with other modular components in various circuit designs. The modular package may include or may be adapted for inclusion with a thermal base, such as a liquid-cooled mounting surface or support. Such surfaces may be provided on one or multiple sides of the inductor structures so as to further enhance the thermal performance.

In accordance with certain aspects of the technique, various additional circuit components may be incorporated into the inductor package. These may include, where desired, inductors of different configuration, capacitor circuits, sensing circuits, and so forth. The integrated nature of such components within the inductor package further enhances the utility of the inductor, while providing a compact modular arrangement that can be easily cooled during operation along with the inductor coil.

In certain configurations, the inductor assembly may include multiple separate inductors that are arranged in a single modular structure. The inductor assembly may thus be adapted for three phase applications, such as in power converter circuits. Such power converter circuits are also envisaged by the invention, with the modularity of the inductor packaging and improved cooling further facilitating construction of a compact, high performance system in conjunction with active and passive switching circuits, such as inverters, filters, and so forth.

By virtue of the packaging techniques offered by the present invention, the invention also offers novel circuit and hardware configurations. Accordingly, the technique enables modular circuits to be built which employ modular inductors with the improved characteristics described herein. Such new circuits include converters, inverters, drive packages, universal power controllers, microturbine generating circuits, universal power source circuits, and so forth.

BRIEF DESCRIPTION OF THE DRAWINGS

The foregoing and other advantages and features of the invention will become apparent upon reading the following detailed description and upon reference to the drawings in which:

FIG. 1 a is a diagrammatical representation of a power converter or controller incorporating inductors in accordance with aspects of the present technique;

FIG. 1*b* is a diagrammatical representation of the circuitry of FIG. 1*a* illustrating certain of the circuit elements in somewhat greater detail;

FIG. 1*c* is a diagrammatical representation of one of the inductors of the circuitry of FIGS. 1*a* and 1*b*, particularly an inductor configured to reduce normal and common mode noise.

FIG. 10 is a diagrammatical representation of an arrangement such as that shown in FIG. 1 with modular inductors incorporated with other circuit components and cooling provided for thermal control of the entire assembly;

FIG. 11 is a diagrammatical representation of an alternative arrangement of the circuits of FIG. 10 on both sides of a cooling support;

FIG. 12 is detailed representation of a portion of a modular inductor incorporating a current sensor;

FIG. 13 is a perspective representation of a portion of a modular inductor incorporating a capacitor winding;

FIG. 14 is a detailed representation of a portion of the assembly of FIG. 13;

FIG. 15 is a partial perspective representation of an exemplary inductor assembly incorporating a principle inductor and a common mode inductor;

FIG. 16 is a detailed view of a portion of the assembly of FIG. 15;

DETAILED DESCRIPTION OF SPECIFIC EMBODIMENTS

Figure 2A:
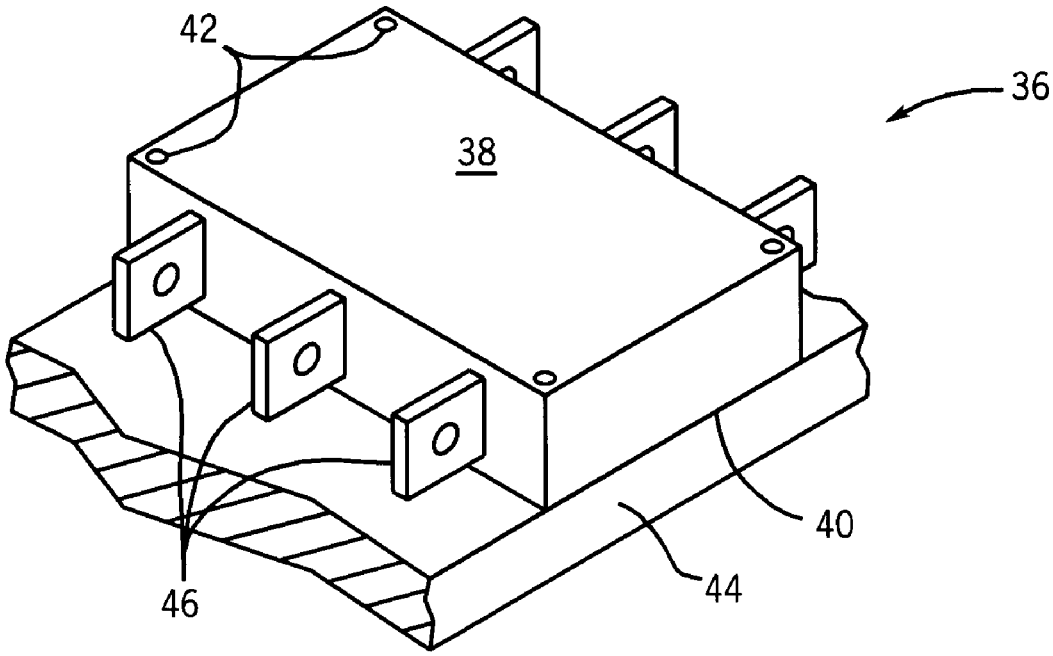
FIG. 2*a* is an exemplary perspective view of an inductor assembly for use in a modular system of the type illustrated in FIG. 1*a;*

Turning now to the drawings, and referring first to FIG. 1*a*, a power converter circuit 10 is illustrated and designated generally by reference numeral 10. In the illustrated embodiment, circuit 10 receives input power, such as via three-phase conductors 12, and produces output power as illustrated at reference numeral 14 for application to a load, such as a motor 16. While reference is made in the present description to a power converter circuit generally, and including specific components, aspects of the present technique relating to configuration of modular inductors, incorporation of such components into systems, and overall system design can be employed in a wide range of circuits and settings. Thus, the present techniques apply equally well to universal power controllers, frequency controllers, micro-turbine generator applications, universal power sources, inverter circuits, matrix converters, by-directional and uni-directional power supplies, and so forth. In certain embodiments, such as that illustrated in FIG. 1*a*, for example, the circuits are designed for receiving power from a grid or utility and applying power to a load. However, in other settings, power may be received from various AC sources, such as micro-turbines, generators and the like, or power may be received in DC form.

Referring again to FIG. 1*a*, the circuit 10 is illustrated as including a first modular inductor 18, a filter 20, a second modular inductor 22, and a switched module 24. In an exemplary embodiment, the switched module may include any suitable components, such as an inverter array of IGBT's and fly-back diodes for converting the incoming AC waveform to DC power. Again in the illustrated embodiment, a further inductor assembly 26 may include DC link inductors, particularly where the circuit arrangement is used as a drive. A further switched module 28 converts the power to an output waveform of desired frequency, and applies the power to a further series of an inductor 30, filter 32, and inductor 34.

As will be appreciated by those skilled in the art, the various components illustrated diagrammatically in FIG. 1*a* may be included, or may not be necessary in all applications. The inductors 18 and 22, for example, serve to condition incoming power, as does the filter circuit 20 (e.g. a sine wave filter tuned to a filtering frequency permitting reduction in the size of the inductors).

It has been found that limitations in reduction in size and further integration of modular components of the type illustrated in FIG. 1 arise due to problems and extracting heat from the components during operation. In particular, where relatively large inductors are incorporated into such systems, currents applied to the inductors can generate substantial thermal energy which, by the present technique, can be efficiently removed from the components, permitting improved performance and more compact packaging.

FIG. 1*b* illustrates certain of the circuitry of FIG. 1*a* in somewhat greater detail. In particular, in the 3-phase of application shown, inductor 18 comprises 3 inductor elements, one for each power phase. Inductor 22, similarly, comprises inductors for each phase, which are equipped with current sensors 116 as described in greater detail below. The filter circuit 20 is represented in an exemplary configuration and may be generally of the type known in the art, such as an arrangement described in U.S. Pat. No. 6,208,537. In the illustration of FIG. 1*b*, inductor 26 is adapted for reduction of normal and common mode noise in the DC bus of the circuitry. Additional details regarding the exemplary construction of inductor 26 in accordance with the present techniques will be described below. The illustrated embodiment includes inductor 30, which is generally similar to inductor 22, comprising of series of three inductors for each power phase, and similarly equipped with current sensors 116. Filter circuit 32 is generally similar to filter circuit 20.

FIG. 1*c* illustrates, diagrammatically, details for interconnection of the inductor elements of inductor 26 illustrated in FIGS. 1*a* and 1*b*. In the illustrated embodiment, and as described in detail below with reference to FIG. 25, the inductor 26 includes a series of 4 inductor elements which are interconnected to reduce normal and common mode noise. Two DC leads are provided, as a two output leads, labeled "+INV$^2$" and "−INV$^2$." Such inductors may also be provided in modular packages which benefit from enhanced thermal performance in accordance with the techniques described herein.

FIG. 2*a* illustrates an exemplary modular packaged inductor, designated generally by reference numeral 36. In practice, the inductor 36 may serve as any one or more of the inductors 18, 22, 30, or 34, and may be adapted to function as inductor assembly 26 in FIG. 1*a*. The embodiment illustrated in FIG. 2*a*, the packaged inductor assembly has an upper surface 38 and a lower surface 40 which serves as a mounting surface for supporting the inductor in an application. Mounting structures may include apertures 42 formed in the inductor package to receive fasteners (not shown) for mounting and securing the inductor to a thermal support as represented generally at reference numeral 44. Other securement techniques may include bonding the inductor package to the support, or any other suitable securement approach. The thermal support 44 functions as a heat sink for conductive thermal transfer from the inductor assembly. The thermal characteristics of the assembly are described in greater detail below. The modular package is conveniently configured in a rectangular (i.e. parallelepipedic or box-like) arrangement, having sides which permit the inductor to be mounted in close association with other components (not shown) in the circuit assembly. Conductive elements, such as lead conductors 46 extend from the inductor 36 for electrical interfacing with adjacent components. In the embodiment illustrated in FIG. 2*a*, for example, the conductors 46 comprise conductive bars which may be directly secured to (e.g. by plugging or stabbing movement) to mating components in the overall circuit. In the illustrated embodiments, the inductor 36 is configured for three-phase operation, such that a series of three parallel sets of conductors 46 are provided. Other conductors or terminals may, of course, be present, such as where the package incorporates other internal components such as sensors, capacitors, common mode inductors, and so forth as described in greater detail below.

Figure 2B:
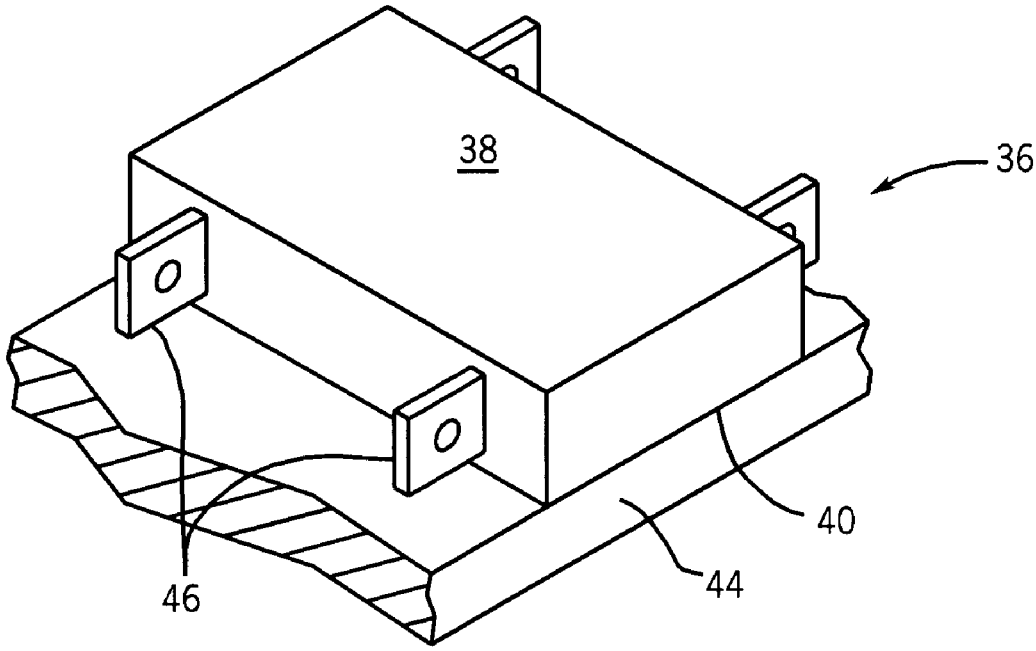
FIG. 2*b* is an exemplary perspective view of an alternative inductor assembly similar to that of FIG. 2*a* but with a reduced number of leads.

For certain conductor configurations, packaging slightly different from that shown in FIG. 2*a* may be provided. In particular, where fewer than three leads are required, such as for inductor 26 illustrated in FIGS. 1*a*, 1*b* and 1*c* and discussed above, and below with reference to FIG. 25, two input leads and two output leads may be provided. The modular package may take the form illustrated in FIG. 2*b*, for example.

Figure 3:
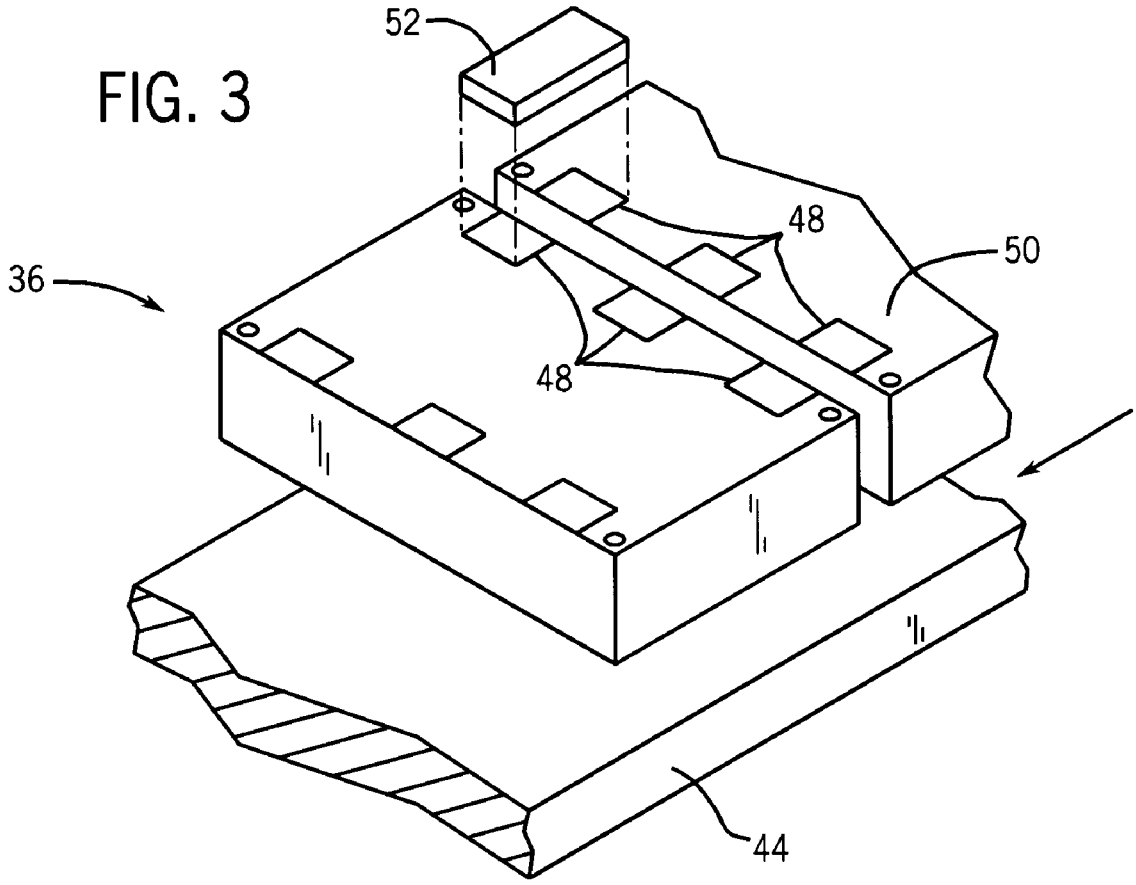
FIG. 3 is a perspective view of a variant of the design illustrated in FIG. 2, illustrating an alternative technique for interfacing the assembly with adjacent circuit components.
Figure 4:
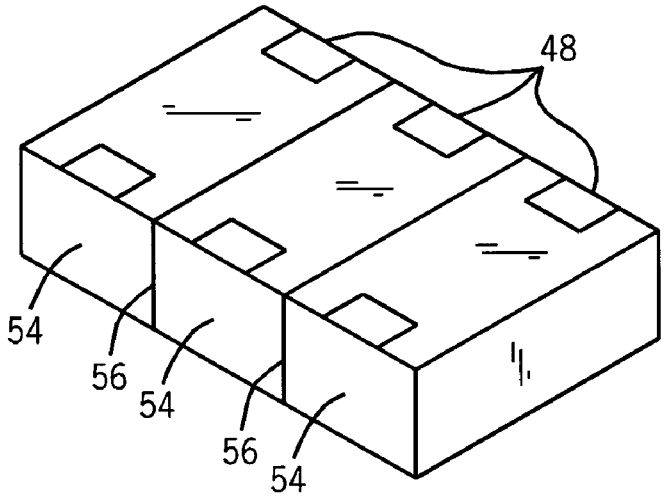
FIG. 4 is a further alternative configuration in which a series of modular inductors are assembled side-by-side.

FIG. 3 illustrates an alternative configuration for the inductor 36 in which the inductor package presents conductive pads 48 designed to interface with similar pads 48 on an adjacent component 50. As noted above, such adjacent components may include power converter circuits, filters, or any other suitable components arranged in close cooperation and electrically coupled to the inductor 36. Plates or jumpers 52 may be secured to the conductive pads 48, such as via fasteners (not shown), soldering, stabbing, snap-type engagement, and so forth. Again as described more fully below, where such close association of the components of the circuit assembly is provided, all of the components may be provided on shared thermal support 44 which may, as in presently contemplated embodiments, be fluid cooled for a conductive/convective heat transfer from the circuit assembly.

Where several inductors are provided in an overall assembly, to enhance the modularity of the structure, several independent packages may be integrated into the structure as illustrated in FIG. 4. In the embodiment of FIG. 4, single-phase inductor assemblies 54 are fabricated and the independent assemblies are then bonded to one another at interfaces 56. It should be noted that as a general matter, the inductor packages in such assemblies need not necessarily of the same rating from both electrical and thermal points of view. For example, in a side-by-side assembly of three such inductors, thermal gradients may cause the middle inductor package to experience greater heating due to its position between the two neighboring inductors. Moreover, in certain applications, it may be desirable to avoid magnetically integrating the packages due to the resulting reluctance. In such situations, the interfaces 56 may be provided so as to magnetically separate the individual inductor packages from one another.

Figure 5:
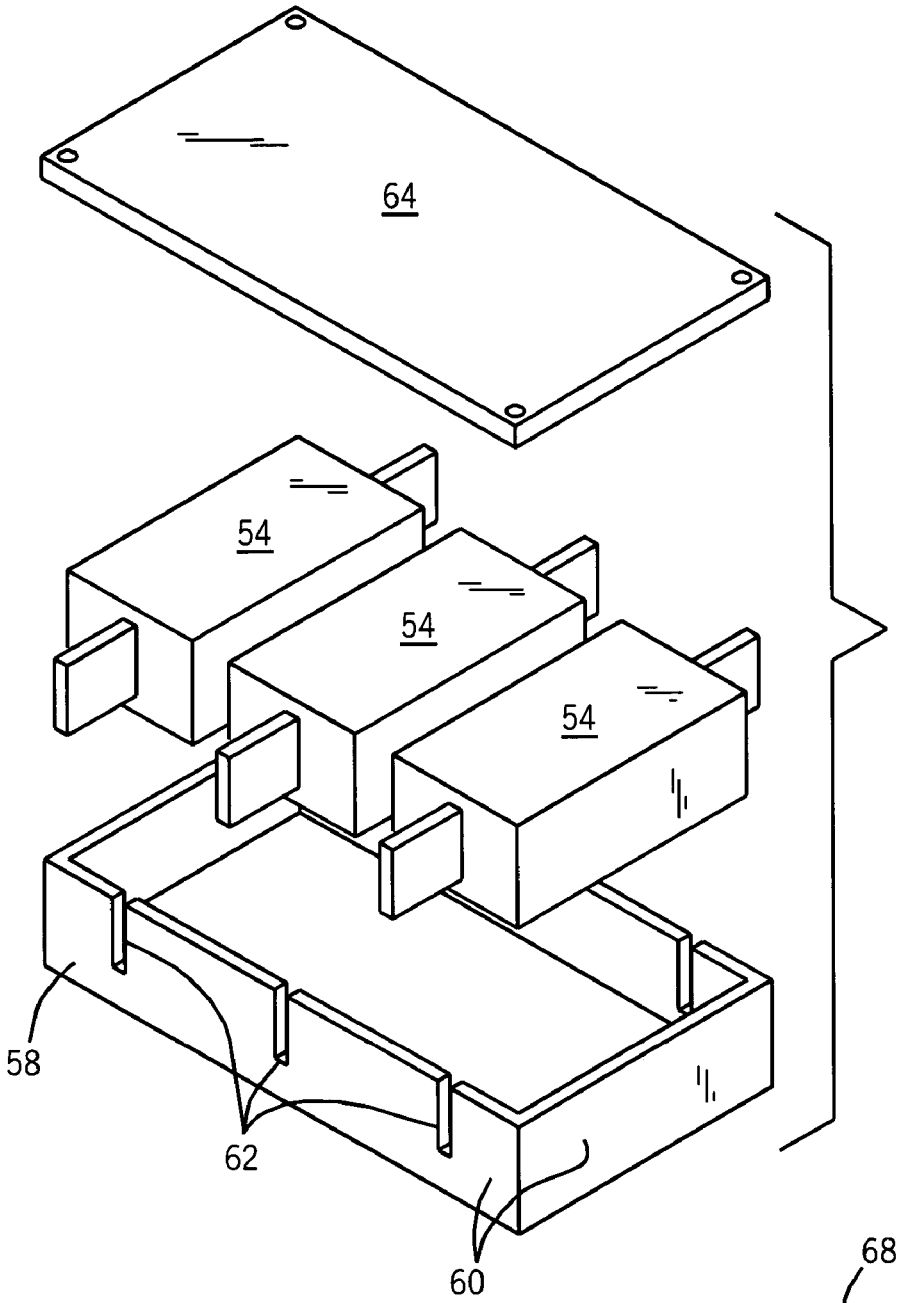
FIG. 5 is an exploded prospective view of an exemplary modular inductor package including a series of modular inductors for three-phase operation.

In a further alternative configuration illustrated generally in FIG. 5, individual inductor packages, such as single-phase inductors 54, may be integrated into an overall assembly, such as a three-phase assembly. Each inductor assembly 54 may be fabricated in accordance with techniques described below, and is then assembled in a single enclosure 58. Enclosure 58 may be made of any suitable material, such as microatomized sintered metal. Sidewalls 60 form an interior volume in which the inductor assemblies 54 are placed. Where each inductor assembly includes a conductor of the type discussed above with reference to FIG. 2, apertures or slots 62 may be provided in the sidewalls to permit the conductors to extend therethrough in the final assembly. Other lead and terminal arrangements may, of course, be provided. A cover 64 is provided to fit over the sidewalls 60 of the enclosure 58. In practice, the inductors are preferably potted within the enclosure in accordance with generally known techniques.

Figure 6:
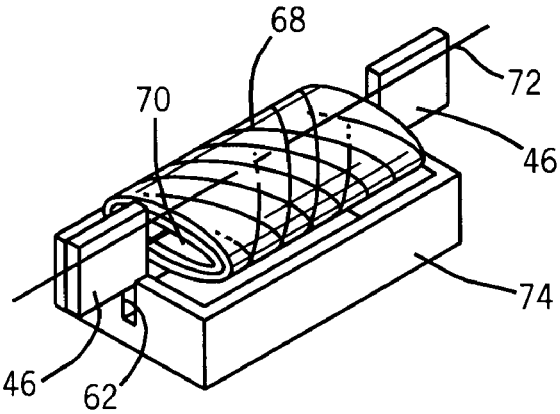
FIG. 6 is perspective view illustrating an exemplary construction technique for fabricating one of the inductors in a package such as that illustrated in FIG. 5.

Various arrangements may be envisaged for improving the thermal extraction capabilities of the inductor package. In accordance with the present techniques, for example, an extremely compact packaging system is offered as illustrated generally in FIG. 6. FIG. 6 generally illustrates a portion of an inductor package of the type employed in the assembly of FIG. 5. As shown in FIG. 6, an inductor coil or winding 68 is formed, such as of litz wire or foil which is wound about a core 70 extending generally along a center line or axis 72. The axis 72 extends generally parallel to the mounting surface of the assembly so as to provide an extremely compact design with a relatively high inductance rating. Conductors 46 are coupled to each end of the inductor winding 68 and the resulting assembly is housed within an enclosure or shell 74. As noted above with respect to enclosure 58 of FIG. 5, the enclosure or shell 74 may be made of any suitable material, such as sintered metal. The inductor assembly is placed within the shell, and the terminal conductors 48 may be provided through slots 62 provided therein. Where other conductor or terminal configurations are provided, such as pads as described above, internal structures for routing of power to and from the inductor coil are provided accordingly. The assembly thus assembled is preferably potted, and covered via a shell similar to shell 74 (not shown) or a cover similar to cover 64 illustrated in FIG. 5.

Figure 7:
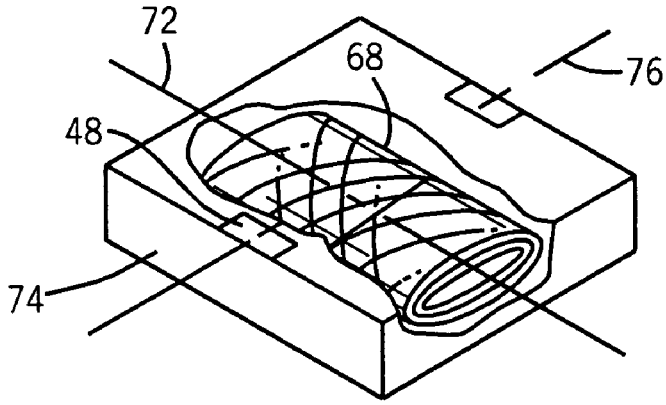
FIG. 7 is a perspective view illustrating an alternative construction technique for a modular inductor assembly.

An alternative configuration for the assembly is illustrated generally in FIG. 7. As shown in FIG. 7, the same inductor winding 68 provided about a core and extending generally along axis 72 parallel to the mounting surface of the package is positioned transverse to an axis 76 along which power flows through the assembly.

Figure 8:
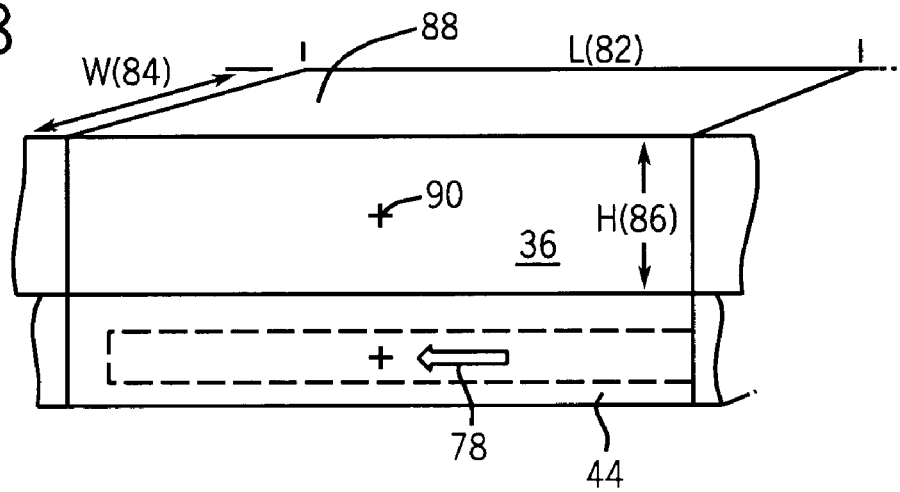
FIG. 8 is a perspective view illustrating construction techniques and principles for improving thermal transfer from a modular inductor by enlargement of the inductor footprint.

As will be noted by those skilled in the art, the arrangement of the inductor winding and package described above differs significantly from heretofore known structures. In particular, the provision of the winding axis of the inductor coil generally parallel to the mounting surface of the package offers a reduced height dimension that facilitates extraction of heat from the assembly. In a currently envisaged implementation, the inductor coil or winding takes on a generally oblong cross-sectional geometry. FIG. 8 generally illustrates certain of the geometric considerations presently contemplated in the design and fabrication of the inductor assembly. As shown in FIG. 8, the inductor 36 is designed to be supported on a thermal support 44 by fasteners, bonding, or any suitable means as discussed above, with the mounting surface of the package in close contact with the thermal support 44. While certain elements may be interposed between the package and the thermal support in practical application, the two components are preferably thermally closely coupled such that heat can be extracted from the inductor during operation, such as by a coolant stream 78. The coolant stream 78 may be applied in open-loop or closed-loop arrangements with a liquid coolant being presently preferred. The coolant may flow through any number of conduits or passage ways, such as provided integrally within the thermal support 44. The reduced temperature of the coolant stream as compared to the operating temperature of the inductor causes a thermal gradient to be established within the inductor package and thermal support.

In the configuration illustrated in FIG. 8, the inductor has a length 82, a width 84 and a height 86. The upper surface 88 may be open to the atmosphere, or may be in close contact with a similar thermal support 44, where desired. Where the package is open to the atmosphere as illustrated in FIG. 8, a thermal gradient is established such that a thermal center 90, representing the hottest point within the assembly, is positioned within the assembly at a location depending upon the operating temperature of the assembly, the surrounding air temperature, the temperature of the coolant stream 78, any convective cooling which may be provided around the assembly, the flow rate of the coolant stream, and the thermal characteristics (e.g. mass and specific heat) of the various components. In general, however, as compared to heretofore known structures, the thermal center 90 of the inductor assembly is relatively low as compared to the height 86. As regards the length and width dimensions, the thermal center 90 may be expected to be located generally at the center of mass of the assembly.

Figure 9:
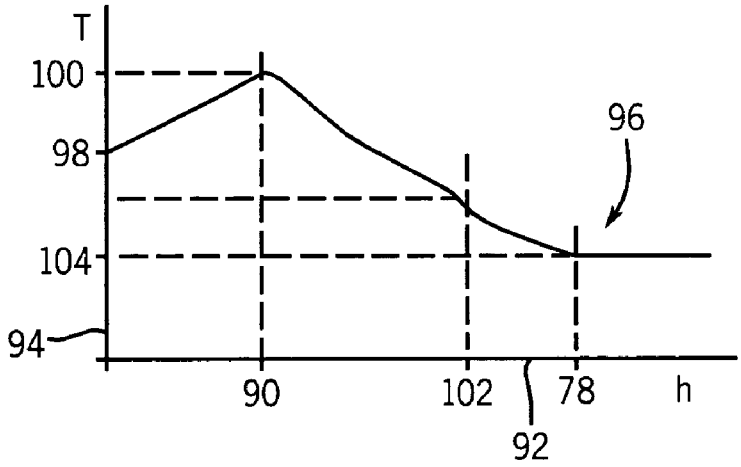
FIG. 9 is an exemplary thermal profile for a modular inductor of the type shown in FIG. 8 during operation.

FIG. 9 generally illustrates a thermal gradient or profile which is established by virtue of the geometry and structure of the inductor assembly, in connection with the thermal cooling provided by the support 44. In the graphical representation of FIG. 9, locations along the height of the assembly are indicated along the horizontal axis 92, while the temperature at such locations is indicated along the vertical axis 94. A thermal gradient or profile 96 can be established representative of the temperature at various locations in the assembly during operation. In general, an upper surface temperature 98 will exist at the upper surface 88 (see FIG. 8) due to the exposure to ambient air or other cooling media. A generally increasing thermal profile will exist to a maximum temperature 100 at the thermal center 90 of the assembly. From that point, the thermal gradient provides a downwardly sloping profile to a point 102 generally corresponding to the interface between the inductor 36 and the support 44. The profile continues downward to a temperature 104 generally corresponding to the temperature of the coolant stream 78.

The present technique provides an expanded footprint as defined by the area resulting from the length 82 and width 84 of the mounting surface of the inductor package. In particular, as compared to heretofore known structures, the expanded footprint of inductor 36 offers greater surface area over which heat may be extracted from the package. Thus, in terms of the graphical representation of FIG. 9, a maximum temperature 100 expected at the thermal center 90 of the assembly will be significantly reduced as compared to heretofore known structures where reduced footprints were available for conductive/convective heat transfer. In practice, the height 86, and the surface area defined by the length 82 and width 84 of the inductor package is preferably selected such that the maximum temperature 100 during operation is significantly below an insulation breakdown temperature or other physical limit of the components within the inductor assembly.

As noted above, the inductors described herein may be incorporated into overall power converter circuitry along with a variety of other components, including switching components, non-switching components, filters, energy storage components, and so forth. The various components illustrated diagrammatically in FIG. 1*a* are shown in FIG. 10 incorporated into a system in which a single thermal support, or an integrated thermal support made up of adjoined elements, extends along the entire expanse of the associated components of the circuit. In the integrated power circuit 106 of FIG. 10, a coolant stream, denoted generally by the letter C, is circulated through the thermal support to extract heat from the various components. Alternative configurations can be envisaged that further reduce the footprint of the overall structure, and render an even more compact design. FIG. 11, for example, illustrates a compact arrangement 108 in which inductors, filters and converting circuits are provided on both sides of a central thermal support. Coolant may be circulated through the thermal support, as again denoted by the letter C. Jumpers, conductors, cables, braids, or other means may be provided for transferring power between circuits on one side of the thermal support and components on an opposite side as indicated generally at reference numeral 110 in FIG. 11.

In addition to being configured for incorporation, in a modular fashion, with other components of power converting circuits, the presently contemplated structure of the modular inductors discussed herein may include integrated components which further enhance the utility of the assembly. As illustrated in FIG. 12, for example, the inductors may incorporate sensors which detect operating parameters such as current or voltage. In the detailed representation of FIG. 12, the core 70 of the inductor is wrapped with the inductor coil or winding 68 as discussed above. A gap 114 may be provided in the core at which point a sensor 116 is placed, such as a Hall effect sensor for detecting current. Leads 118 from the sensor are routed out of the assembly, such as through ends of the coil as illustrated generally in FIGS. 6 and 7 above. In operation, magnetic flux generated during operation of the inductor results in signals being produced by the sensor 116 which are conveyed via leads 118 to external circuitry, such as for current detection, voltage measurement, ground fault sensing, and so forth.

In a further variant on the modular inductor design, capacitor structures may be integrated within the package as illustrated generally in FIG. 13. As shown in FIG. 13, an inductor/capacitor assembly 120 designed to be incorporated into an enclosure as described above, includes an insulator 122 which is provided between the inductor coils 68 and a capacitor winding 124. The capacitor winding may comprise any suitable material, such as a conductive foil with interposed layers of Kapton as a dielectric. Again, both the inductor coil 68 and the capacitor coil or winding 124 preferably extend along an axis 72 which, in the assembled package, is generally parallel to the mounting surface of the package. Capacitor leads 126 may extend from the ends of the capacitor winding for connection to external circuitry. As will be appreciated by those skilled in the art, the integration of a capacitor within the inductor package may facilitate even more compact overall circuit designs in which such components, rather than being provided separately, are packaged together and heat from both components is extracted as described above.

FIG. 14 generally illustrates a detailed view of a portion of the assembly of FIG. 13, showing the positioning of an insulating layer 122 between the inductor coil 68 and the capacitor winding 124.

The present technique also permits incorporation of multiple inductors within a single package. By way of example, FIG. 15 illustrates an inductor assembly 128 that includes a first inductor coil 68 wound generally about an axis 72, with an insulating layer 130 provided around the periphery thereof. A second inductor coil 132 is wound over the insulator 130 and may serve various purposes in the resulting circuitry, such as for a common mode inductor. A diagrammatical representation of this arrangement of coils and insulator is also represented in FIG. 16. The winding arrangement of FIGS. 15 and 16 may serve, in a resulting circuit, as, for example, a DC link inductor and a common mode inductor in a single package. As noted above, the foregoing structures may be incorporated into a wide range of applications, particularly for power conversion.

Figure 17:
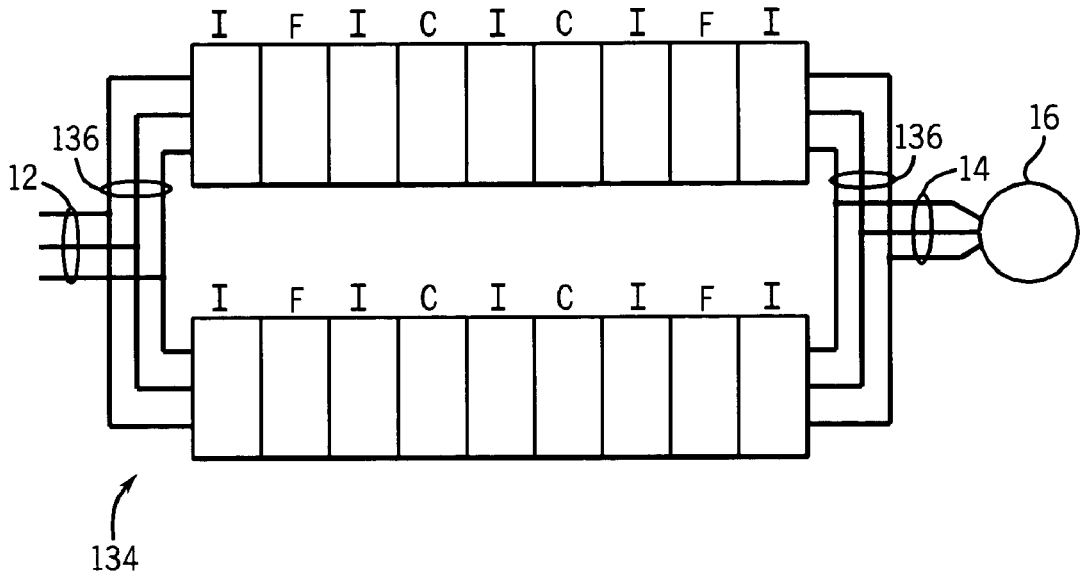
FIG. 17 is a diagrammatical representation of a modular assembly of power converters incorporating inductors in accordance with the present techniques.

Arrangements built on the basis of the modular packaging described above may include multiple circuits in series and in parallel, such as illustrated generally in FIG. 17. In the embodiment of FIG. 17, a modular, parallel configuration is provided and indicated generally by reference numeral 134. The arrangement includes a pair of circuits (although more than two such assemblies may be provided) of the type discussed generally above with reference to FIG. 1*a*. Interconnections 136 are provided between the circuits for routing incoming and outgoing power between conductors, such as coupled to a power grid and to an application, typically an electrical load. The high degree of modularity of the inductors and other components described herein greatly facilitates the packaging of such arrangements in an extremely compact and thermally-efficient manner.

Figure 18:
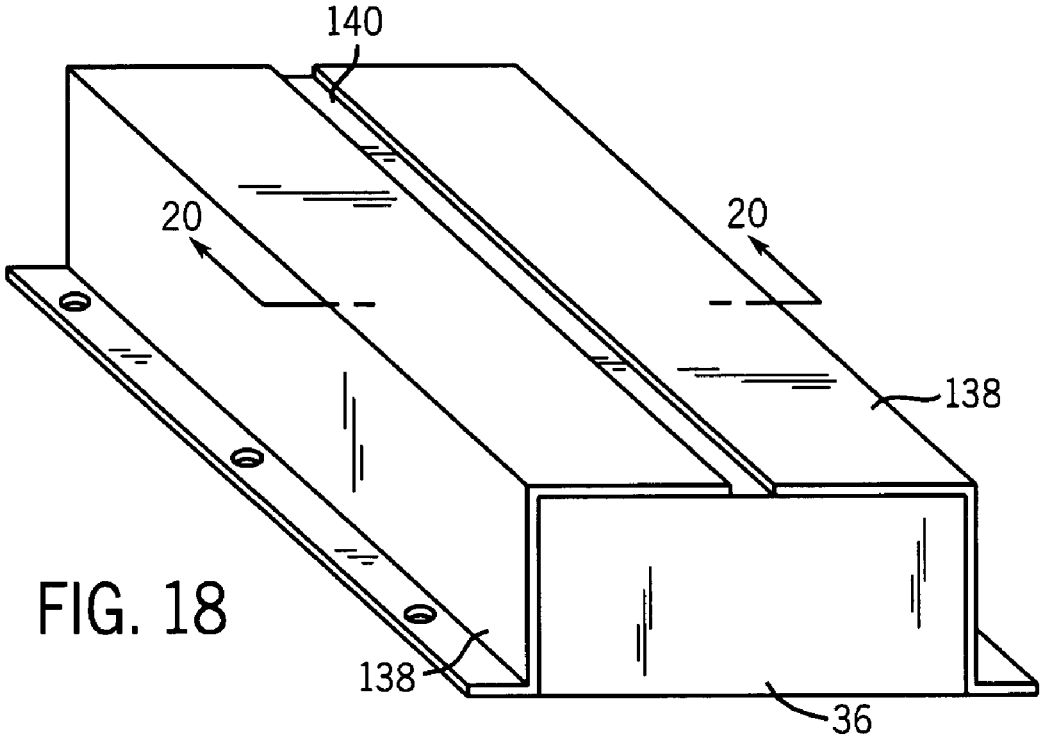
FIG. 18 is an exemplary perspective view of an inductor with mounting hardware in an alternative embodiment.

Various alternative configurations to the inductor packaging described above may also be envisaged. One such packaging arrangement is illustrated in FIG. 18. As shown in FIG. 18, a package inductor 36 may be provided with mechanical hardware, such as brackets 138 to secure the inductor in a desired location and orientation in an overall circuit assembly. Brackets 138 are preferably non-magnetic, and provide an open magnetic path, while channeling heat back heat back to a support surface. To ensure the open magnetic path, a gap 40 may be defined between the brackets. Heat, then, emanating from surface of the packaged inductor will be absorbed by the brackets and will be directed back to the base region on which the brackets and inductor are mounted.

Figure 19:
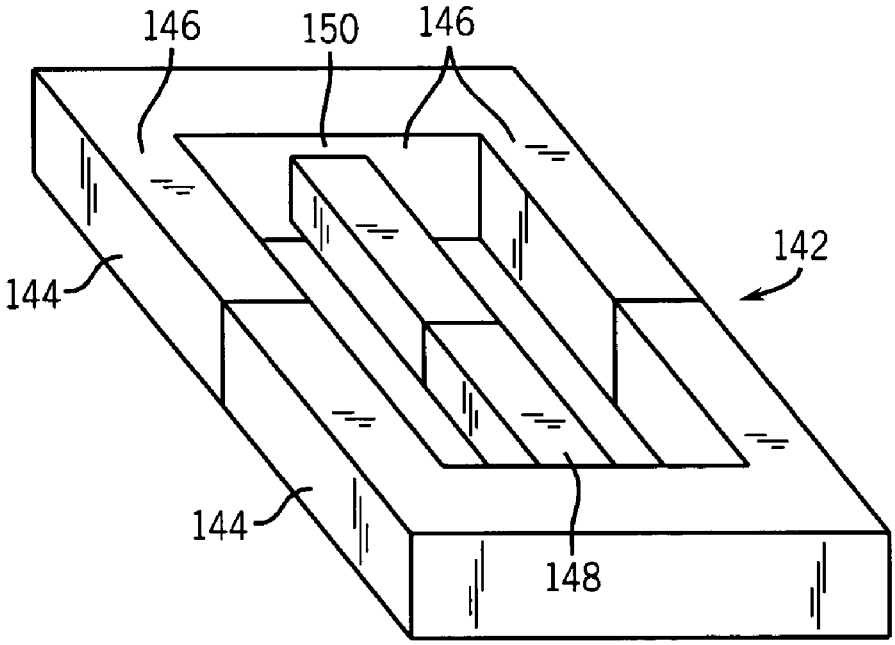
FIG. 19 is a perspective view of an exemplary core for an inductor of the type shown in FIG. 18.

FIG. 19 shows an exemplary core structure which may be used in any one of the foregoing arrangements, and particularly in the packaged inductor 36 shown in FIG. 18. As shown in FIG. 19, the core, indicated generally be reference numeral 142, may be made of any suitable material, such as iron or any other suitable magnetic material. The core, as illustrated in FIG. 19, may be comprised of two or more elements, such as E-shaped elements 144. Other element types, including C-shaped and I-shaped elements may, of course, be utilized in the core assembly. The use of multiple elements that are joined to form the desired magnetic circuit presents the benefits of facilitating winding of the inductor coils, or installation of the coils and a bobbin or mandrel on or in the core. The core presents magnetic loop portions 146 and a central portion 148 that extends between ends of the loop portions. In the exemplary embodiment illustrated, a recess 150 is provided on upper and lower sides of the central portion 148 to accommodate the inductor coil or coils, as well as other internal elements as described below.

Figure 20:
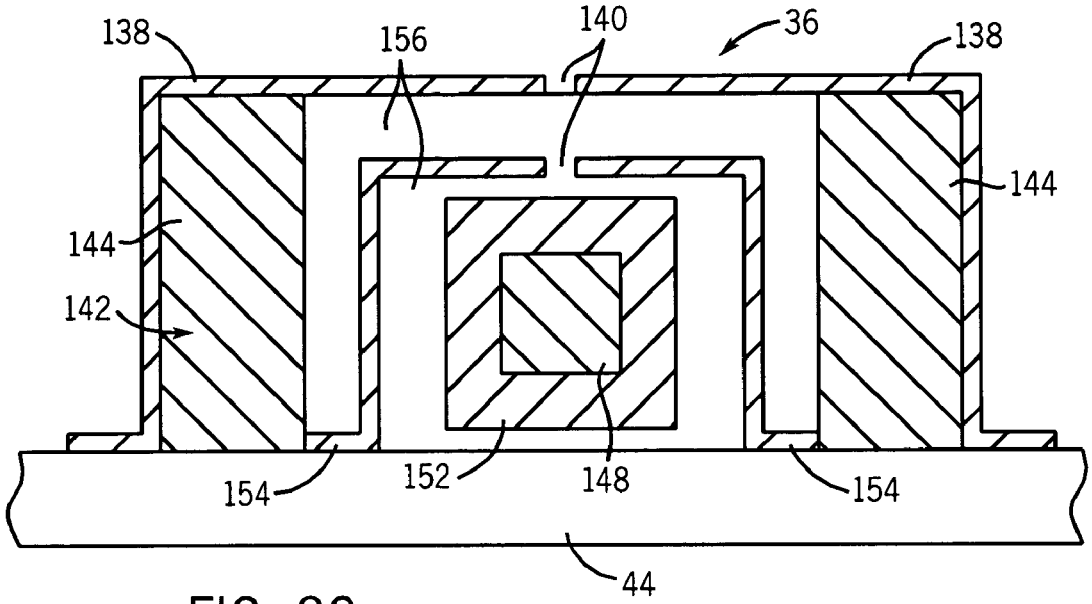
FIG. 20 is a sectional view of the inductor assembly of FIG. 18 illustrating exemplary internal components thereof.

FIG. 20 illustrates a sectional view through the mounted packaged inductor 36 of FIG. 18. As shown in FIG. 20, the inductor has a core 142 of the type shown in FIG. 19. Moreover, the package of FIG. 20 has a coil of bobbin 52 disposed around the central portion 148 of the core. As noted above, this coil may include one or more inductor coils, as well as instrumentation, sensors, and so forth. In particular, it should be noted that, where one or more current sensors is provided, such sensors may be installed at a gap defined at a location where the core elements 144 meet, such as in the middle of the central portion 148 (see FIG. 19). In the embodiment illustrated in FIG. 20, further thermal managements is facilitated by a thermal shunt 154 that is provided between the central portion 148 of the core and the outer portions thereof. The thermal shunt 154 is designed to receive thermal energy generated during operation of the inductor, and to direct such thermal energy to the thermal support 144 on which the inductor package is mounted. As with brackets 138, thermal shunt 154 preferably prevents an open magnetic path by virtue of a gap 140 between shunt elements. Around coil 152, and between the coil and the base of the package inductor, and other internal elements, a thermally conductive potting material, such as epoxy is disposed, as indicated generally by reference numeral 156. Such areas a preferably of a minimum thickness so as to enhance the exchange of thermal energy between the various components and to facilitate cooling of the components via the thermal support 44.

Figure 21:
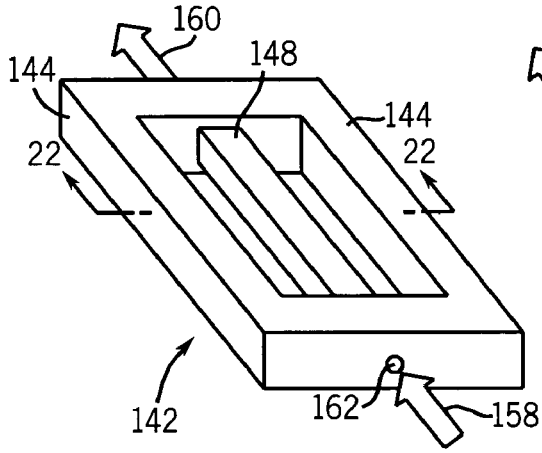
FIG. 21 is a perspective view of an exemplary inductor core similar to that shown in FIG. 19, but adapted to receive a coolant stream.
Figure 23:
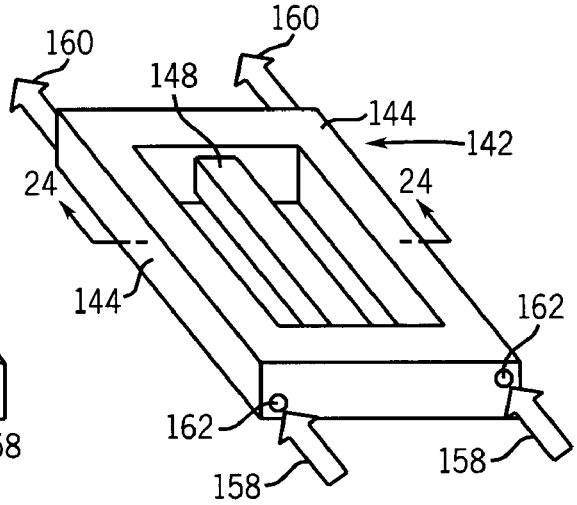
FIG. 23 is a perspective view of an alternative core adapted to receive a coolant stream.
Figure 22:
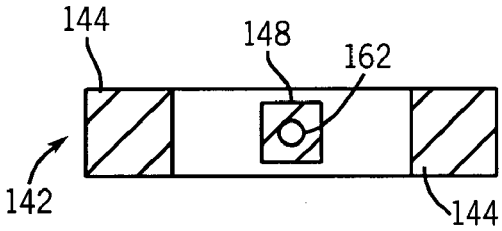
FIG. 22 is a sectional view of the core of FIG. 21.
Figure 24:
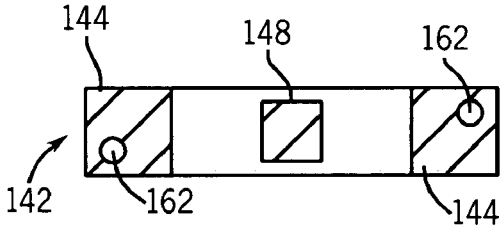
FIG. 24 is a sectional view of the core of FIG. 23.

To further enhance the thermal management of the inductor assembly, the core itself may be designed to receive a coolant stream, as indicated in FIGS. 21–24. FIG. 21 illustrates a core design similar to that shown in FIG. 19. The core, however, is designed to receive an input coolant stream as indicated at reference numeral 158, and to re-circulate the coolant stream as indicated at reference numeral 160. In the embodiment of FIG. 21, and as best shown in the cross-sectional view of FIG. 22, an aperture 162 is provided in the core, which extends fully through the central portion 148. Similarly, as shown in FIGS. 23 and 24, coolant apertures 162 may be provided in other areas of the core, such as adjacent to corners thereof. Such placement may facilitate maintaining the desired maximum temperatures and temperature gradients within the inductor package during operation.

Figure 25:
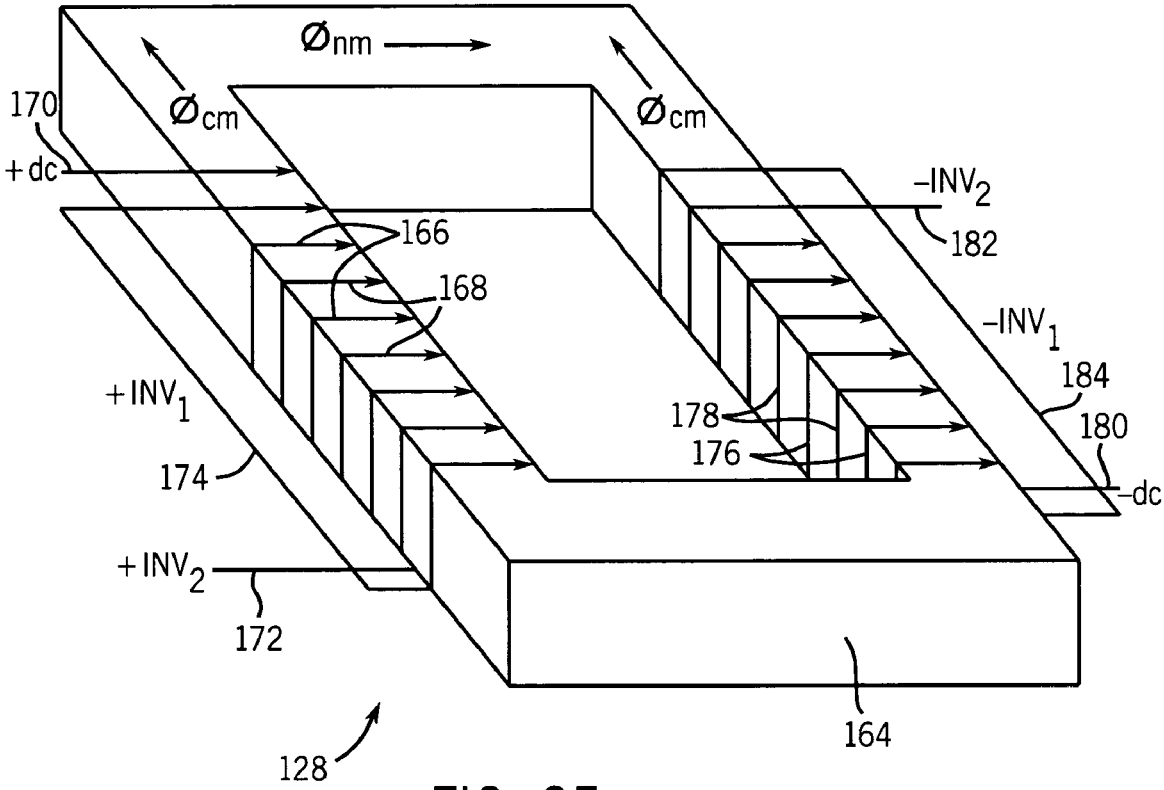
FIG. 25 is perspective view of an exemplary inductor element illustrating diagrammatically, a manner in which normal and common mode noise reducing coils can be provided in the module inductor package.

As noted, various coil configurations may be incorporated into inductors in accordance with the present techniques. A further exemplary embodiment of a modular inductor mounted on a core similar to those described above is illustrated in FIG. 25. The modular inductor of FIG. 25 is, however, designed to reduce normal and common mode noise. In the illustrated embodiment, the combination inductor assembly 128 includes a core 164 which may be generally similar to the cores described above in reference to FIGS. 19 through 24. However, no central portion is provided in the core. A series of inductor coils, including four coils are wound around sides of the core. The inductor windings 166 and 168 define windings which are provided on a high or positive side of a DC bus, as illustrated generally in FIG. 1*c* above. The coils are wound in the same direction, and interleaved with one another to induce coupling. As will be appreciated by those skilled in the art, the windings are configured in accordance with the well-known right-hand rule, with leads to the coils being provided for the DC bus, as indicated with reference numeral 170, and for an output from the circuitry, as indicated at reference numeral 172, and labeled "$+INV_2$." The output lead from the first coil 166 is coupled to the input of coil 168, as indicated at reference numeral 174, and may be labeled "$+INV_1$" to correspond to the arrangement illustrated in FIG. 1*c* above.

On an opposite side the core, a similar arrangement is provided. That is, coils 176 and 178 are wound in a same direction in accordance with the right-hand rule. A DC bus input is provided at lead 180, and an output lead 182 maybe labeled "$-INV_2$" to correspond to the arrangement illustrated in FIG. 1*c* above. The output of coil 176 is coupled to the input of coil 178, as indicated at reference numeral 184, in a lead that may be labeled "$-INV_1$" corresponding to the arrangement of FIG. 1*c* above. The resulting inductor may be packaged as described above, and benefits from enhanced thermal characteristics, as well as the modular packaging which facilitates its interconnection with other circuitry of the overall circuit assembly.

While the invention may be susceptible to various modifications and alternative forms, specific embodiments have been shown in the drawings and have been described in detail herein by way of example only. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A modular inductor for use in power electronic circuits, the inductor comprising:

a modular enclosure having a mounting surface extending generally in a plane;

an inductor coil wound about a central axis extending generally parallel to the mounting surface; and a plurality of leads electrically coupled to the inductor coil and accessible from the modular enclosure;

wherein the modular enclosure is configured for mounting adjacent to similar modular inductors in a multi-phase inductor assembly.

2. The inductor of claim 1, further comprising a liquid cooled base, the enclosure being mounted to the base for conductive heat transfer through the mounting surface.

3. The inductor of claim 1, wherein the coil is generally oblong in a cross section transverse to the central axis.

4. The inductor of claim 1, wherein the modular enclosure has a plurality of generally flat external surfaces including side surfaces adjacent to the mounting surface, and wherein the mounting surface has a greater surface area than any one of the side surfaces.

5. The inductor of claim 1, wherein the leads include plug-in terminals configured to engage interfacing conductors of other components in a circuit in which the inductor is incorporated for use.

6. The inductor of claim 1, wherein the leads include conductive pads for interconnecting the inductor with other components in a circuit in which the inductor is incorporated for use.

7. The inductor of claim 1, wherein a first lead is disposed on a first side of the modular package and a second lead is disposed on a second side opposite the first side.

8. The inductor of claim 1, further comprising a current sensor disposed within the enclosure and configured to sense current through the inductor.

9. The inductor of claim 8, wherein the sensor is configured to sense ground faults of the inductor coil.

10. The inductor of claim 1, further comprising a capacitor wound with the inductor coil.

11. The inductor of claim 1, further comprising a second, common mode inductor coil wound within the enclosure.

12. A modular inductor system for use in power electronic circuits, the inductor comprising:

a modular enclosure having a mounting surface extending generally in a plane;

three modular inductors disposed in the enclosure, each inductor being configured for electrical connection to a respective phase of three phase electrical system;

a plurality of leads electrically coupled to the inductors for interfacing the inductors with adjacent components of the three phase electrical system; and a current sensor disposed within the enclosure and configured to sense current through at least one of the inductors.

13. The inductor system of claim 12, further comprising a liquid cooled base, the enclosure being mounted to the base for conductive heat transfer through the mounting surface.

14. The inductor system of claim 12, wherein each inductor includes a coil wound about an axis generally parallel to the mounting surface.

15. The inductor system of claim 12, wherein the inductors are potted within the enclosure.

16. A power converter assembly comprising:

a power converter circuit configured to convert incoming power to controlled three-phase outgoing power;

a modular inductor assembly configured to be coupled between the power converter circuit and a source of electrical power, the inductor assembly comprising a modular enclosure having a mounting surface extending generally in a plane, an inductor coil wound about a central axis extending generally parallel to the mounting surface, and a plurality of leads electrically coupled to the inductor coil and accessible from the modular enclosure for coupling the inductor assembly to the power converter circuit; and a current sensor disposed in the enclosure and configured to sense current through the inductor coil.

17. The power converter assembly of claim 16, wherein the inductor assembly includes three modular inductors disposed in the enclosure, each inductor being configured for electrical connection to a respective phase of three phase electrical system.

18. The power converter assembly of claim 17, further comprising a fluid cooled support, at least the inductor assembly being mounted on the fluid cooled support for extraction of heat from the inductor assembly via the mounting surface.

19. The power converter assembly of claim 16, further comprising a second inductor assembly electrically coupled in series with the inductor assembly, and a filter circuit electrically coupled in series between the inductor assembly and to the second inductor assembly.

20. A power converter assembly comprising:

a power converter circuit configured to convert incoming power to controlled three-phase outgoing power;

a modular inductor assembly configured to be coupled between the power converter circuit and a source of electrical power, the inductor assembly comprising a modular enclosure and three modular inductors disposed in the enclosure, each inductor being configured for electrical connection to a respective phase of the power converter circuit, the enclosure having a mounting surface extending generally in a plane; and a fluid cooled support, the power converter circuit and the inductor assembly being mounted on the fluid cooled support for extraction of heat from the inductor assembly via the mounting surface.

* * * * *